US006384672B2

(12) United States Patent
Oh

(10) Patent No.: US 6,384,672 B2
(45) Date of Patent: May 7, 2002

(54) DUAL INTERNAL VOLTAGE GENERATING APPARATUS

(75) Inventor: Young-Nam Oh, Ichon-shi (KR)

(73) Assignee: Hyundai Electronics Industries Co., Ltd. (KR)

( * ) Notice: Subject to any disclaimer, the term of this patent is extended or adjusted under 35 U.S.C. 154(b) by 0 days.

(21) Appl. No.: 09/745,838

(22) Filed: Dec. 26, 2000

(30) Foreign Application Priority Data

Dec. 23, 1999 (KR) ..... 99-60930

(51) Int. Cl.[7] ..... G05F 1/10

(52) U.S. Cl. ..... 327/541; 327/540; 323/316; 323/267; 323/269

(58) Field of Search ..... 327/540, 541, 327/543; 323/316, 267, 269

(56) References Cited

U.S. PATENT DOCUMENTS

| | | | | | |
|---|---|---|---|---|---|
| 5,144,585 | A | * | 9/1992 | Min et al. | 365/226 |
| 5,266,838 | A | * | 11/1993 | Gerner | 307/19 |
| 5,554,953 | A | * | 9/1996 | Shibayama et al. | 323/315 |
| 5,747,974 | A | * | 5/1998 | Jeon | 323/269 |
| 5,774,813 | A | * | 6/1998 | Jokinen | 455/343 |
| 6,191,994 | B1 | * | 2/2001 | Ooishi | 327/538 |
| 6,201,374 | B1 | * | 3/2001 | Ater et al. | 323/267 |

* cited by examiner

*Primary Examiner*—Terry D. Cunningham
(74) *Attorney, Agent, or Firm*—Pillsbury Winthrop LLP

(57) ABSTRACT

To accomplish low power consumption of a semiconductor memory device, an internal voltage generating apparatus of the present invention applies an internal power voltage having the lower potential level as an operation voltage of a chip. By differentiating the internal power voltage for each of a peripheral circuit and a core circuit within a DRAM to use them as an operational voltage of the cell, i.e., by supplying the lowered internal power voltage to the core circuit unit, the reliability of the cell and noise characteristic is improved.

14 Claims, 4 Drawing Sheets

REFERENCE POTENTIAL GENERATING UNIT
VREF0
VREF1
VREF1_AMF_PERI
VREF1_AMF_CORE
VREF2_PERI
VREF2_CORE
VBIAS1
VBIAS2
POWER VOLTAGE DETECTOR
PERIPHERAL CIRCUIT
CORE CIRCUIT
VINT1
VINT2
ACT_PERI
ACT_CORE
VCC
MP1
MP2
MP3
MP4
MP5
R1
R2
R3
R4
1
2
3
5
7
9
11
12
14
22
24
32
34
120
220
240
320
340
420
440
520
540

DUAL INTERNAL VOLTAGE GENERATING APPARATUS

BACKGROUND

1. Field of Invention

The inventions described and claimed relate in general to powering semiconductor devices. More specifically, they relate to internal voltage generating arrangements.

2. General Background and Related Art

Generally, it is desirable to operate portable electronic devices at as low a power consumption level as possible. In fact, power consumption level is probably one of the most competitive issues among manufacturers of portable electronic devices, semiconductor memory devices, etc. To minimize power consumption, it is helpful to operate semiconductor devices as voltages lower than those of externally supplied voltages. Therefore, an internal power voltage, lower than an externally supplied power voltage, is generated and used to operate semiconductor devices.

Because the power consumption of a CMOS circuit is proportional to square of voltage, power consumption can be reduced significantly, if the internal power voltage can be lowered. It is particularly helpful when the internal voltage source can be set and maintained to a static voltage. When this can be accomplished the operation of the chip is stable because the operational voltage is stable even when the external power voltage has some variation.

The semiconductor chip should operate normally (e.g., has constant access time) even when the external power voltage varies by 10%. This requirement can lead to circuit complexity. If a stable power source could be provided by an internal voltage generating apparatus, circuit design can be made simpler, which has many design advantages. For this reason, the concept of using an internal voltage generating apparatus was introduced.

FIG. 1 (Prior Art) is a circuit diagram of a conventional internal voltage generating apparatus. It includes a reference potential generating unit 100 for generating a reference voltage VREF1 having a predetermined potential level. A potential amplifying unit 200 amplifies the reference voltage VREF1. A reference potential converting unit 300 converts the potential of the reference voltage VREF1 by comparing a bias voltage VBIAS generated at a power voltage detector 10 with an output voltage VREF1_AMF from the potential amplifying unit 200. A driver unit 400 supplies a second reference voltage VREF2 converted at the reference potential converting unit 300 to a DRAM internal circuit 500 as an operational voltage in each of a standby mode and an active mode. The reference potential generating unit 100 is typically implemented by a Widlar Current Mirror which is well known in the art and its detailed description is omitted.

The potential amplifying unit 200 includes a comparator 1 receiving the reference voltage VREF1 at one of its two inputs. A PMOS transistor MP1 is coupled between a power voltage input Vcc and an output N1. Transistor MP1 has a gate coupled to the output of comparator 1. Two resistors R1 and R2 are serially coupled between the output N1 and ground for providing a feedback potential signal VA, resulting from voltage division based on the ratio of resistors R1 and R2, to the other one of the two inputs of the comparator 1.

The reference potential converting unit 300 includes a comparator 3 receiving the output potential VREF1_AMF from the potential amplifying unit 200 at one of its two inputs and a current sink ground voltage at the other one of its two inputs. A comparator 5 receives the bias voltage from the power voltage detector 10 at one of its two inputs. The other input of comparator 5 is coupled to a current sink ground voltage. Two PMOS transistors MP2 and MP3 are coupled in parallel to each other between the power voltage input Vcc and the current sink output N2. A gate of PMOS transistor MP2 is coupled to the output of the comparator 3 and a gate of PMOS transistor MP3 is coupled to the output of the comparator 5.

Driver unit 400 includes a standby driver 20 and an active driver 30. Drivers 20 and 30 are voltage followers that supply an operational voltage corresponding to the second reference voltage VREF2 in for standby mode and active mode, respectively. Drivers 20 and 30 include comparators 7 and 9, respectively, each receiving the second reference voltage VREF2 at ones of their two inputs and the current sink ground voltage at their other inputs, respectively. Two PMOS transistors MP4 and MP5 are coupled respectively between the power voltage input Vcc and the current sink output N2. A gate of PMOS transistor MP4 is coupled to the output of comparator 7 and a gate of PMOS transistor MP5 is coupled to the output of the comparator 9. The internal power voltage VINT1 is applied to the DRAM internal circuit 500 through a common drain of the two PMOS transistors MP4 and MP5.

The DRAM internal circuit 500 can be divided roughly into the core circuit block, i.e., a memory cell block, and the peripheral circuit block. In order to improve reliability of the memory cell, it is required that the operational voltage of the core circuit block is set to be low by supplying the core circuit block with a power voltage lower than the power voltage of the peripheral circuit block.

However, as will be appreciated referring to an output waveform of the internal voltage shown in FIG. 2 (Prior Art), the conventional internal voltage generating apparatus generates a single internal voltage VINT1 by using a single voltage drop circuit, which leads some operational difficulties.

Firstly, due to the internal power voltage being a single potential level, operational current value To determined by $(Cp \times VINT1 + Cc \times VINT1) \times freq$ and subsequently memory core current increased. Accordingly, over-current flows through a cell capacitor and a swing voltage and a gate voltage of the cell increase. This voltage increase is bad for power consumption as well as in the cell reliability.

Furthermore, a noise characteristic of a circuit so powered deteriorates due to mutual noise interference of the core circuit block and the peripheral circuit block.

SUMMARY

With this background in mind, the claimed inventions feature, at least in part a dual internal voltage generating arrangement. The voltage generating arrangements presented herein generate internal power voltages used respectively as operational voltages for 1) a peripheral circuit block and 2) a core circuit block of a memory chip. This allows for the operational voltage of the cell used for core to be a lower and stable level.

One exemplary embodiment of the inventions includes a dual internal voltage generating apparatus. A reference potential generating unit generates a reference voltage VREF1 of a predetermined potential level. First and second potential amplifying units, parallel to each other, amplify the reference voltage VREF1. A first reference potential converting unit converts the reference voltage to a first potential level by comparing a first bias voltage generated at a corresponding power voltage detector with the output voltage from the first potential amplifying unit. A second reference potential converting unit converts the reference voltage to a second potential level by comparing a second bias voltage generated at a corresponding power voltage detector with the output voltage from the second potential amplifying unit. A first driver unit receives the reference voltage generated at the first reference potential converting unit for generating a first internal voltage to be supplied to a peripheral circuit unit within a DRAM. A second driver unit receives the reference voltage generated at the second reference potential converting unit for generating a second internal voltage to be supplied to a core circuit unit within the DRAM.

BRIEF DESCRIPTION OF THE DRAWINGS

Exemplary embodiments of the claimed inventions will be described in detail with reference to the accompanying drawings, in which:

DETAILED DESCRIPTION

Figure 1:
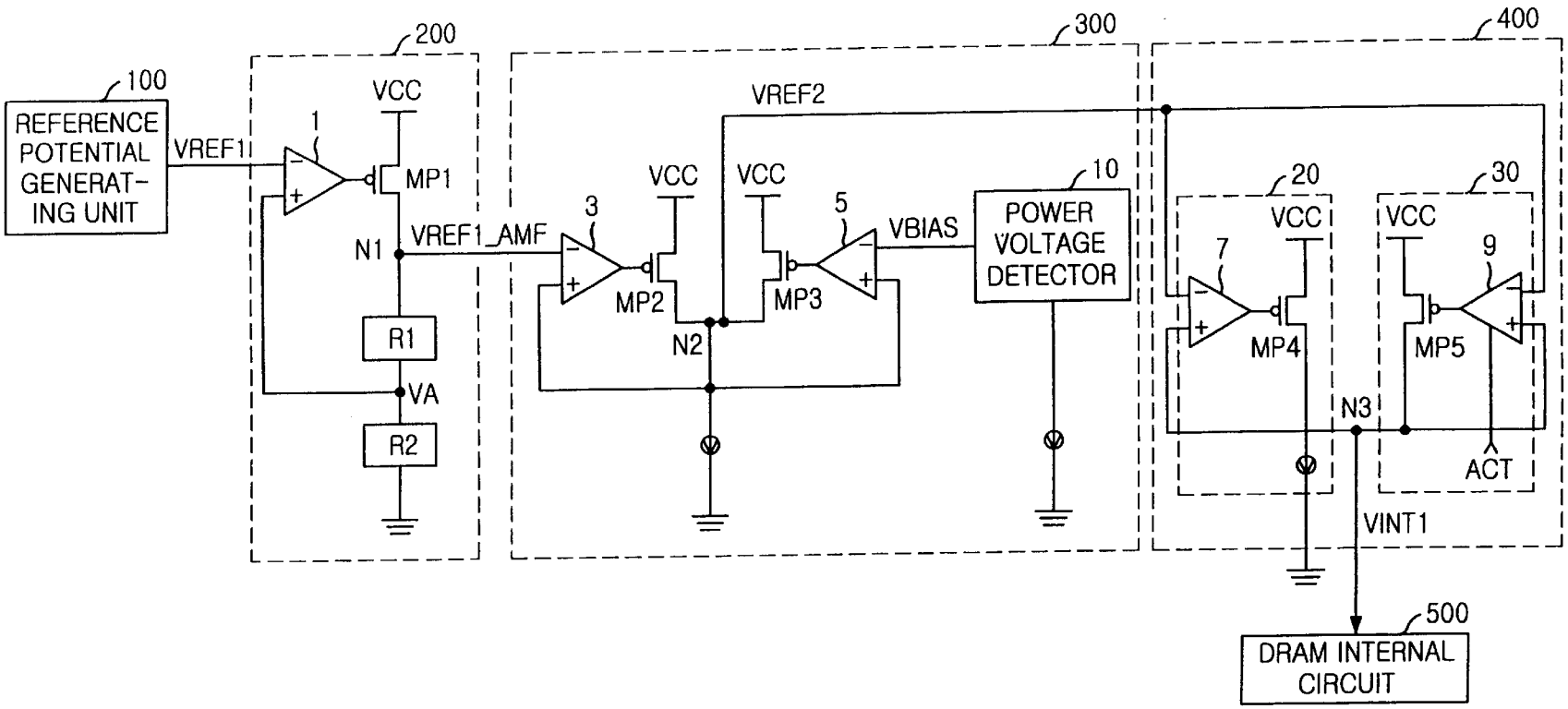
FIG. 1 (PRIOR ART)
FIG. 1 (Prior Art) is a circuit diagram of a conventional internal voltage generating apparatus.
Figure 2:
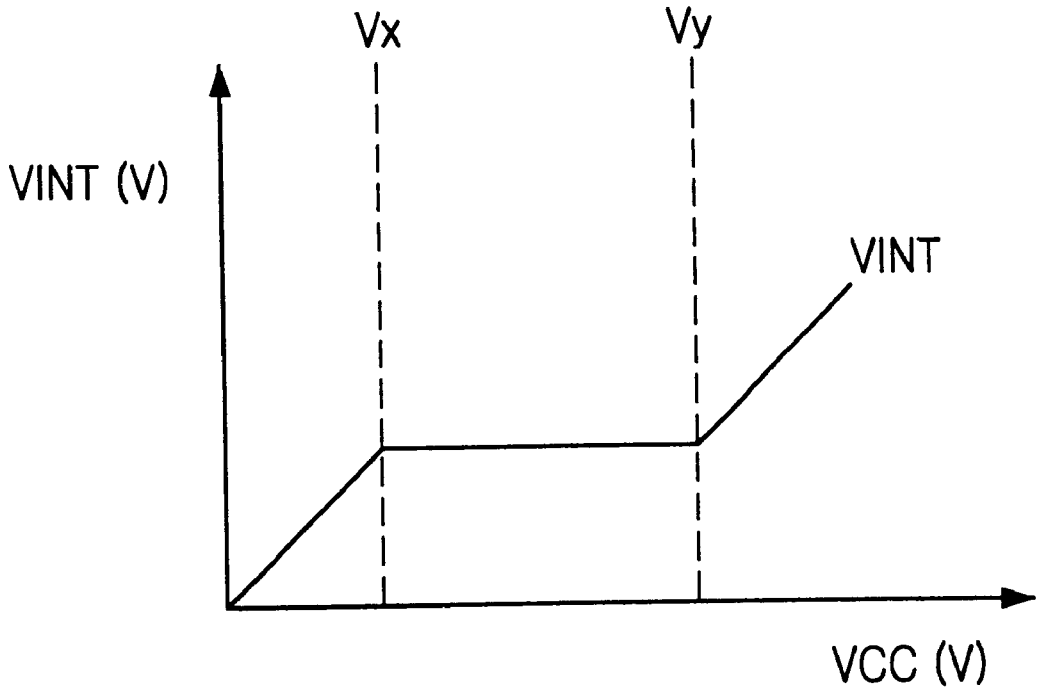
FIG. 2 (PRIOR ART)
FIG. 2 (Prior Art) shows an output waveform of the internal voltage generated in FIG. 1 (Prior Art)
Figure 3:
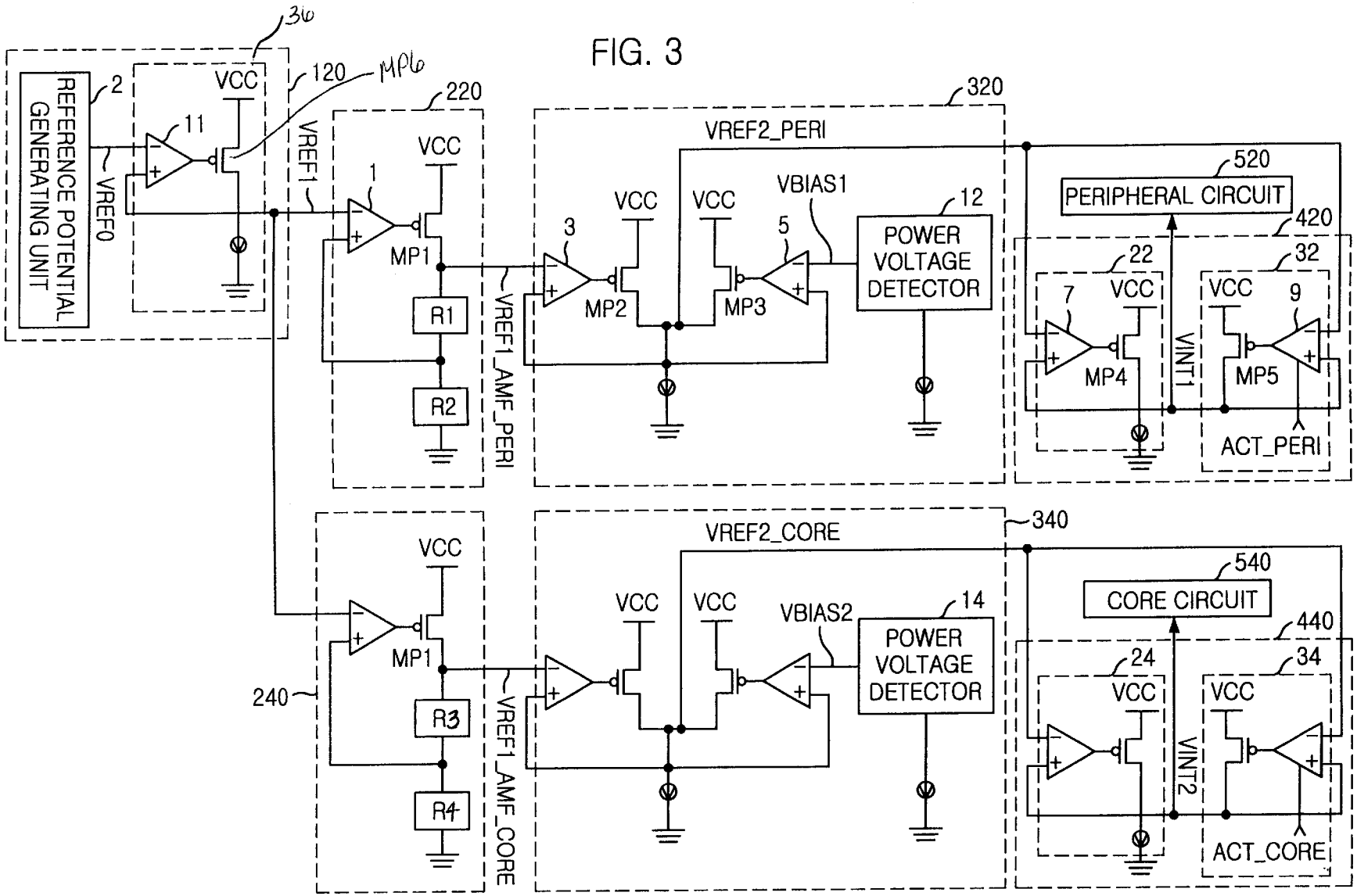
FIG. 3 is a circuit diagram of an exemplary embodiment of a dual internal voltage generating apparatus in accordance with the present invention.

FIG. 3 is a circuit diagram of an exemplary embodiment of a dual internal voltage generating apparatus in accordance with the present invention. A reference potential generating unit 120 generates a reference voltage VREF1 of a predetermined potential level. First and a second potential amplifying units 220 and 240, parallel to each other, amplify the reference voltage VREF1. A first reference potential converting unit 320 converts the reference voltage VREF1 to a potential level VREF1_PERI by comparing a first bias voltage VBIAS 1 generated at a power voltage detector 12 with the output voltage VREF1_AMF_PERI from the first potential amplifying unit 220. A second reference potential converting unit 340 converts the reference voltage VREF1 to a potential level VREF2_CORE by comparing a second bias voltage VBIAS2 generated at a power voltage detector 14 with the output voltage VREF1_AMF_CORE from the second potential amplifying unit 240. A first driver unit 420 receives the reference voltage VREF2_PERI generated at the first reference potential converting unit 320 and generates a first internal voltage VINT1 to be supplied to a peripheral circuit unit 520, internal of a DRAM. A second driver unit 440 receives the reference voltage VREF2_CORE generated at the second reference potential converting unit 340 and generates a second internal voltage VINT2 to be supplied to a core circuit unit 540, internal of a DRAM.

The reference potential generating unit 120 includes a reference potential generator 2 and a voltage follower 36 adjusting current driving capability of a reference voltage VREF0 generated at the reference potential generator 2.

The reference potential generator 2 can be implemented as a "Widlar current Mirror" which is well known in the art and its detail description is omitted for the sake of simplicity. Of course, other implementations are possible.

The voltage follower 36 includes a comparator 11 having an input to which the reference voltage VREF0 is applied from the reference potential generator 2. A PMOS transistor MP6 has a gate coupled to the output of comparator 11, a source coupled to input potential Vcc and a drain coupled to a current source sinked to ground. The drain provides feedback to a second input of comparator 11. The reference voltage VREF1 generated as described above is transferred to one input of each of the first and the second potential amplifying units 220 and 240.

The potential amplifying units 220, 240 can be configured so as to be identical to potential amplifying unit 100 in its general circuit configuration and operation. However, they are constructed and arranged to have serially coupled resistors R1, R2 and R3, R4, respectively for voltage distribution to differentiate the outputted reference potentials VREF1_AMF_PERI, VREF1_AMF_CORE.

Because the reference potential VREF1_AMF_CORE from the second potential amplifying unit 240 controls a supply voltage provided to the core circuit unit 540 of the internal of the DRAM, the resistance ratios of the resistors R1 to R4 are selected so that the potential VREF1_AMF_CORE from unit 240 will be lower than the reference potential VREF1_AMF_PERI from potential amplifying unit 220.

Potential levels of the reference potential signals VREF1_AMF_PERI, VREF1_AMF_CORE, from the first and the second potential amplifying units 220, 240, respectively are determined in accordance with the voltage distribution law as follows:

$$VREF1_AMF_PERI=(R1+R2)\times VREF1/R2 \quad \text{Eq.(1)}$$

$$VREF1_AMF_CORE=(R3+R4)\times VREF1/R4 \quad \text{Eq.(2)}$$

Accordingly, by properly selecting the values of resistance of resistors R1, R2, R3 and R4, the reference potentials VREF1_AMF_PERI, VREF1_AMF_CORE, from the first and the second potential amplifying units 220, 240, can be controlled.

For example, assuming that VREF1=0.7 V, R1=2.57×R2, and R3=2.14×R4, the output potential of the first potential amplifying unit 220 adjusted to have 2.5 V and the output potential of the second potential amplifying unit 240 adjusted to have 2.2 V are applied to the reference potential converting units 320 and 340, respectively.

Reference potential converting unit 320 includes a comparator 3 receiving the output potential VREF1_AMF_PERI from the first potential amplifying unit 220 at one of its two inputs and a current sink ground voltage at the other one of its two inputs. A comparator 5 receives the first bias voltage from power voltage detector 12 at one of its two inputs and a current sink ground voltage at the other one of its two inputs. Two PMOS transistors MP2, MP3 are coupled in parallel to each other between the power voltage input and a current sink output N2. A gate of transistor MP2 is coupled to the output of comparator 3. A gate of transistor MP3 is coupled to the output of the comparator 5.

Its operation will be described as follows:

$$VREF2_PERI=VREF1_AMF_PERI \text{ (where } VCC<Vy) \quad \text{Eq.(3)}$$

$$VREF2_PERI=VCC-nVt \text{ (where } VCC>Vy) \quad \text{Eq.(4)}$$

The second reference potential converting unit 340 is as similar to the first reference potential converting unit 320 and its detail description will be omitted for the sake of simplicity.

Its operation will be described as follows:

$$VREF2_CORE=VREF1_AMF_CORE \text{ (where } VCC<Vy) \quad \text{Eq. (5)}$$

$$VREF2_CORE=VCC-nVt \text{ (where } VCC>Vy) \quad \text{Eq.(6)}$$

Reference potentials VREF2_PERI, VREF2_CORE converted as above are applied to the drivers 420 and 440, respectively, as their reference voltages. The driver unit 420 includes voltage followers 22 and 32, each supplying the operational voltage corresponding to the reference voltage VREF2_PERI in the standby mode and the active mode, respectively, to the peripheral circuit unit 520. Driver unit 440 includes voltage followers 24 and 34, each for supplying the operational voltage corresponding to the reference voltage VREF2_CORE in the standby mode and the active mode, respectively, to the core circuit unit 540. For the voltage followers 32 and 34 for the active mode, control clocks ACT_PERI, ACT_CORE for the active mode are applied as control signals of the comparators of the voltage followers 32 and 34, respectively, to supply the operational voltage only in the active mode.

Thus, the internal power voltages VINT2, VINT1, respectively, supplied to the core circuit unit 540 and the peripheral circuit unit 520 included within the DRAM can be differentiated. More particularly, the internal power voltage VINT2 supplied to the core circuit unit 540 can be made lower than the internal power voltage VINT1.

Figure 4:
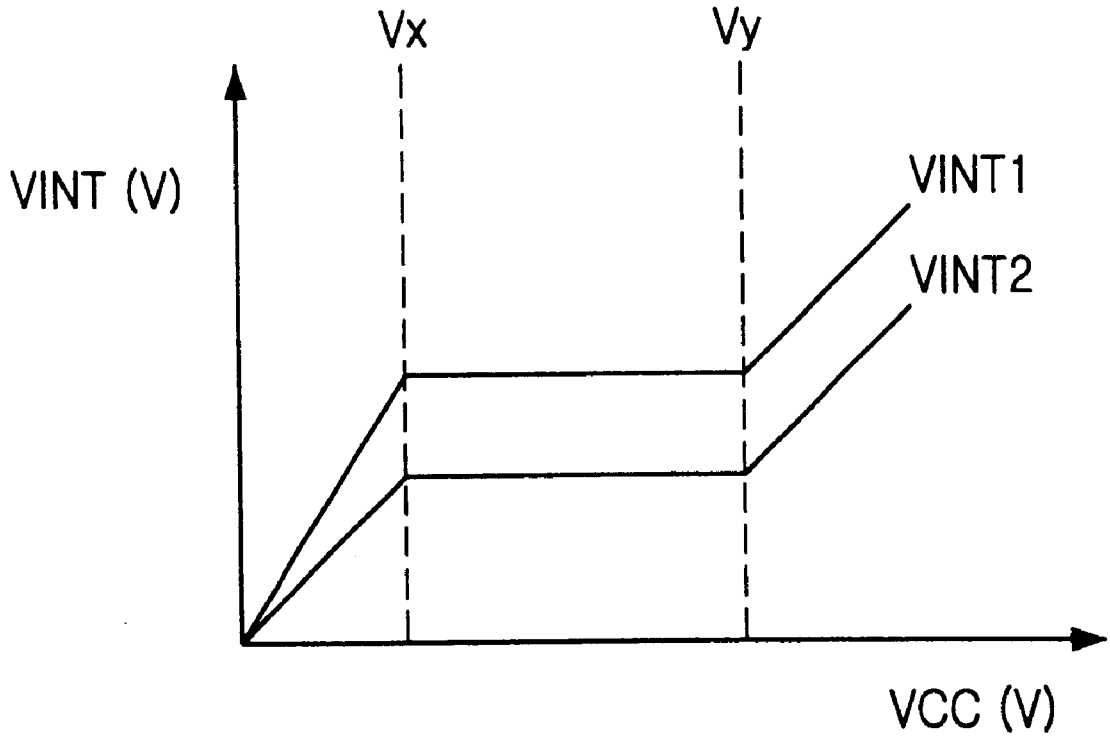
FIG. 4 is a graphical representation of voltages generated by the dual voltage generating apparatus shown in FIG. 3.

FIG. 4 is a graphical representation of voltages generated by the circuit arrangement shown in FIG. 3. Internal power voltages VINT1 and VINT2 are differentiated. By applying the internal power voltage having the lower potential level (herein, VINT2) to the core circuit unit 540 within the DRAM, the operational voltage of the cell used in the core can be adjusted to a stable level.

As described above, the dual internal voltage generating apparatus of the present invention accomplishes low power consumption by lowering the operational voltage of the cell by supplying the lowered internal power voltage to the core circuit unit. Furthermore, the reliability of the cell is improved by the decreased swing voltage and gate voltage of the cell and the noise characteristic is improved by minimizing noise interference between the core circuit unit and the peripheral circuit unit by using the differentiated internal voltages.

While the present invention has been shown and described with respect to the particular embodiments, it will be apparent to those skilled in the art that many changes and modifications may be made without departing from the spirit and scope of the invention as defined in the appended claims.

What is claimed is:

1. A dual internal voltage generating apparatus comprising;

a reference potential generating means for generating a reference voltage having a predetermined potential level;

a first and a second potential amplifying means, parallel to each other, for amplifying the reference voltage;

a first reference potential converting means for converting the reference voltage to a first potential level by comparing a first bias voltage generated at a corresponding power voltage detector with the output voltage from the first potential amplifying means;

a second reference potential converting means for converting the reference voltage to a second potential level by comparing a second bias voltage generated at a corresponding power voltage detector with the output voltage from the second potential amplifying means;

a first driver means receiving the reference voltage generated at the first reference potential converting means for generating a first internal voltage to be supplied to a peripheral circuit means within a DRAM; and a second driver means receiving the reference voltage generated at the second reference potential converting means for generating a second internal voltage to be supplied to a core circuit means within the DRAM.

2. An apparatus according to claim 1, wherein each of the first and the second potential amplifying means includes:

a comparator receiving the reference voltage at a first input thereof;

a PMOS transistor MP1 coupled between a power voltage input and an output and having a gate coupled to an output of the comparator; and first and a second resistors coupled serially between the output and a ground for providing a feedback potential signal based on the ratio of resistance of the first and second resistors to a second input of the comparator.

3. An apparatus according to claim 2, wherein the ratio of the resistance of the first and the second resistors of the first potential amplifying means is determined to be higher than the ratio of the resistance of the first and the second resistors of the second potential amplifying means.

4. An e apparatus according to claim 1, wherein the first reference potential converting means includes:

a first comparator receiving the output potential from the first potential amplifying means at a first input thereof and a current sink ground voltage at a second input thereof;

a second comparator receiving the first bias voltage from a first power voltage detector at a first input thereof and a current sink ground voltage at a second inputs thereof; and first and a second PMOS transistors coupled parallel to each other between the power voltage input and a current sink output, a gate of the first PMOS transistor being coupled to the output of the first comparator and a gate of the second PMOS transistor being coupled to the output of the second comparator.

5. An apparatus according to claim 4, wherein the second reference potential converting means includes:

a third comparator receiving the output potential from the second potential amplifying means at a first input thereof and a current sink ground voltage at a second input thereof, a fourth comparator receiving the second bias voltage from a second power voltage detector a first input thereof and a current sink ground voltage at a second inputs thereof; and a third and a fourth PMOS transistors couple parallel to each other between the power voltage input and a current sink output, a gate of the third PMOS transistor being coupled to the output of the third comparator and a gate of the fourth PMOS transistor being coupled to the output of the fourth comparator.

6. An apparatus according to claim 1, wherein the first driver means includes a standby driver and an active driver for supplying the operational voltage corresponding to the output voltage of the first reference potential converting means in a standby mode and an active mode, respectively, and second driver means includes a standby driver and an active driver for supplying the operational voltage corresponding to the output voltage of the second reference potential converting means in the standby mode and the active mode, respectively.

7. An apparatus as recited in claim 6, wherein each of the standby drivers and the active drivers is a voltage follower.

8. A dual internal voltage generator, comprising;

a reference potential generator constructed and arranged to generate a reference voltage having a predetermined potential level;

first and a second potential amplifiers, constructed and arranged in parallel with each other, to amplifying the reference voltage;

a first reference potential converter constructed and arranged to convert the reference voltage to a first potential level by comparing a first bias voltage generated at a corresponding power voltage detector with the output voltage from the first potential amplifier;

a second reference potential converter constructed and arranged to convert the reference voltage to a second potential level by comparing a second bias voltage generated at a corresponding power voltage detector with the output voltage from the second potential amplifier;

a first driver constructed and arranged to receive the reference voltage generated at the first reference potential converter and generate a first internal voltage to be supplied to a peripheral circuit within a DRAM; and a second driver constructed and arranged to receive the reference voltage generated at the second reference potential converter and generate a second internal voltage to be supplied to a core circuit within the DRAM.

9. An apparatus according to claim 8, wherein each of the first and the second potential amplifiers includes:

a comparator receiving the reference voltage at a first input thereof; a PMOS transistor MP1 coupled between a power voltage input and an output and having a gate coupled to an output of the comparator; and first and a second resistors coupled serially between the output and a ground for providing a feedback potential signal based on the ratio of resistance of the first and second resistors to a second input of the comparator.

10. An apparatus according to claim 9, wherein the ratio of the resistance of the first and the second resistors of the first potential amplifier is determined to be higher than the ratio of the resistance of the first and the second resistors of the second potential amplifier.

11. An apparatus according to claim 8, wherein the first reference potential converter includes:

a first comparator receiving the output potential from the first potential amplifying means at a first input thereof and a current sink ground voltage at a second input thereof;

a second comparator receiving the first bias voltage from a first power voltage detector at a first input thereof and a current sink ground voltage at a second inputs thereof; and first and a second PMOS transistors coupled parallel to each other between the power voltage input and a current sink output, a gate of the first PMOS transistor being coupled to the output of the first comparator and a gate of the second PMOS transistor being coupled to the output of the second comparator.

12. An apparatus according to claim 11, wherein the second reference potential converter includes:

a third comparator receiving the output potential from the second potential amplifying means at a first input thereof and a current sink ground voltage at a second input thereof;

a fourth comparator receiving the second bias voltage from a second power voltage detector a first input thereof and a current sink ground voltage at a second inputs thereof; and a third and a fourth PMOS transistors couple parallel to each other between the power voltage input and a current sink output, a gate of the third PMOS transistor being coupled to the output of the third comparator and a gate of the fourth PMOS transistor being coupled to the output of the fourth comparator.

13. An apparatus according to claim 8, wherein the first driver includes a standby driver and an active driver for supplying the operational voltage corresponding to the output voltage of the first reference potential converter in a standby mode and an active mode, respectively, and the second driver includes a standby driver and an active driver for supplying the operational voltage corresponding to the output voltage of the second reference potential converter in the standby mode and the active mode, respectively.

14. An apparatus as recited in claim 13, wherein each of the standby drivers and the active drivers is a voltage follower.

* * * * *